United States Patent [19]

Reist

[11] Patent Number: 4,604,851

[45] Date of Patent: Aug. 12, 1986

[54] METHOD AND APPARATUS FOR THE INTERMEDIATE STORAGE OF PRINTED PRODUCTS ARRIVING IN AN IMBRICATED PRODUCT FORMATION SUCH AS NEWSPAPERS, PERIODICALS AND THE LIKE

[75] Inventor: Walter Reist, Hinwil, Switzerland

[73] Assignee: Ferag AG, Hinwil, Switzerland

[21] Appl. No.: 616,677

[22] Filed: Jun. 4, 1984

[30] Foreign Application Priority Data

Jun. 9, 1983 [CH] Switzerland ..... 3159/83

[51] Int. Cl.[4] ..... B65B 63/04; B65H 29/70

[52] U.S. Cl. ..... 53/430; 53/118; 271/204; 271/902; 242/59; 414/29

[58] Field of Search ..... 53/430, 118, 593, 587, 53/556, 441, 211, 212, 214; 198/447, 402; 271/204, 206, 300, 902, 151, 202, 216, 303; 414/29, 32, 57, 68; 242/59, 67.2, 67.3 R, 67.4, 55, DIG. 2; 270/52, 54, 56, 52.5; 206/390, 412

[56] References Cited

U.S. PATENT DOCUMENTS

| | | | |
|---|---|---|---|
| 1,902,312 | 3/1933 | Rous | 206/412 |
| 3,488,917 | 1/1970 | Oswald et al. | 414/29 X |
| 4,010,945 | 3/1977 | Kistner | 271/255 X |
| 4,039,182 | 8/1977 | Reist et al. | 271/204 X |
| 4,214,743 | 7/1980 | Meier | 271/902 X |
| 4,438,618 | 3/1984 | Honegger | 414/29 X |
| 4,509,703 | 4/1985 | Grunder | 271/204 X |

FOREIGN PATENT DOCUMENTS

| | | | |
|---|---|---|---|
| 2092557 | 2/1981 | United Kingdom | 242/59 |

*Primary Examiner*—Horace M. Culver
*Attorney, Agent, or Firm*—Werner W. Kleeman

[57] ABSTRACT

Printed products delivered in imbricated product formation by a conveyor having individually releasable grippers are deposited upon a belt conveyor also in imbricated product formation. This imbricated product formation is delivered to a turning device in which the printed products are singled by acceleration and are also inverted. After leaving this turning device, the printed products are conveyed against a fixed stop. After impinging upon this stop, the printed products fall upon a belt conveyor, respectively upon an already formed imbricated product formation. In this imbricated product formation the leading edges are exposed, just as they are in the arriving imbricated product formation. However, the now leading edges are formed by those edges of the printed product which formed the trailing edges in the arriving imbricated product formation. Furthermore, in the newly formed imbricated product formation the originally upper side of the printed products now lies on the underside. The newly formed imbricated product formation is delivered in "underfeed" to a winding mandril and is wound up on the latter to a compact wound product package. When this imbricated product formation is unwound from the package, an inversion of the corresponding imbricated product formation suffices to obtain an imbricated product formation in which the printed products have the same position as in the arriving imbricated product formation.

22 Claims, 4 Drawing Figures

A
B
D
D'
E
F
G
H
a
1
1'
1a
1b
2
3
4
5
6
7
7a
9
10
11
13
14
15
15a
21
22
23
24
24a
S
S1
S2

A
B
D
E
F
G
I
II
S
S1
S2
1
1'
1a
1a'
2
3
3'
4
4'
5
5'
6
6'
7
7'
7a
7a'
8
8'
9
9'
10
10'
11
12
12'
14
16
18
25
25'
26
27

METHOD AND APPARATUS FOR THE INTERMEDIATE STORAGE OF PRINTED PRODUCTS ARRIVING IN AN IMBRICATED PRODUCT FORMATION SUCH AS NEWSPAPERS, PERIODICALS AND THE LIKE

CROSS REFERENCE TO A RELATED APPLICATION

This application is related to the co-pending and commonly assigned U.S. patent application Ser. No. 06/616,676 filed June 4, 1984 and entitled "Method and Apparatus for the Intermediate Storage of Printed Products Arriving in Imbricated Product Formation".

BACKGROUND OF THE INVENTION

The present invention broadly relates to the intermediate storage of printed products and, more specifically, pertains to a new and improved method and apparatus for the intermediate storage of printed products arriving in an imbricated product formation or stream, such as newspapers, periodicals and the like.

Generally speaking, the method of the present invention for the intermediate storage of printed products arriving in an imbricated product formation or stream comprises the steps of delivering the printed products in an imbricated product formation with predetermined edges of the printed products trailing and winding-up the printed products in imbricated product formation upon a winding mandril and conjointly with a winding band or strap maintained under tension to form coil or wound product package with the leading edges located adjacent a next inner layer of the coil or wound product package being formed.

The apparatus of the present invention for the intermediate storage of printed products arriving in an imbricated product formation or stream comprises a rotatable and driveable winding arbor or mandril for winding up the printed products into an imbricated product formation, a conveyor device for transporting the imbricated product formation to be wound up to the winding mandril, respectively to a coil or wound product package being formed thereupon, a winding band or strap operatively connected to the winding mandril and capable of being placed under tension, the winding band or strap being entrained between coil layers of the coil or wound product package being formed as the imbricated product formation is wound up, predetermined edges of the printed products trailing within the imbricated product formation and the altered imbricated product formation being wound up such that the leading edges of the printed products are adjacent to the winding mandril, respectively to the coil or wound product package forming upon the winding mandril.

A method of this type and an apparatus of this type are known, for instance from the U.S. Pat. No. 4,438,618, granted Mar. 27, 1984. According to this known solution, the imbricated product formation is wound up as it arrives, for instance from a rotary printing press or rotogravure machine, that is with the leading edges of the printed products, which are normally the folded edges, upward. Since the imbricated product formation is delivered to the winding mandril in so-to-speak "underfeed", that is with the leading edges of the printed products closer to the axis of rotation of the winding mandril than the trailing edges, conjointly with a winding band or strap, the printed products are deposited with their leading edges adjacent to or in contact with the coil or wound package. This measure assures that each inner layer of the coil or package can be further rotated in the winding direction of the coil or package in relation to the next outer layer. It is therefore possible to further rotate or wind up the coil or package from the interior in the manner of a clock spring and to thereby compact the product coil or wound package.

This type of intermediate storage of printed products in an intermediate storage coil or wound package has, however, the disadvantage that when the printed products are unwound or wound off, they have another position or orientation within the imbricated product formation carried away from the intermediate storage coil or package than they did within the imbricated product formation delivered to the intermediate storage coil or package. This is undesirable in further processing.

It has been proposed, for instance in the commonly assigned U.S. patent application Ser. No. 06/338,568, filed Jan. 11, 1982, since granted as U.S. Pat. No. 4,494,359 on Jan. 22, 1985, and the cognate British Pat. No. 2,092,557, to again wind up the imbricated product formation removed from the intermediate storage coil or package to a second transfer coil or package in order to recreate the original imbricated product formation. The imbricated product formation wound off this second transfer coil or package will now correspond to the original imbricated product formation in respect to the position or orientation of the printed products within this imbricated product formation, but a considerable amount of equipment is necessary to achieve this goal.

SUMMARY OF THE INVENTION

Therefore, with the foregoing in mind it is a primary object of the present invention to provide a new and improved method and apparatus for the intermediate storage of printed products arriving in an imbricated product formation which do not have associated therewith the aforementioned drawbacks and shortcomings of the prior art constructions.

Another and more specific object of the present invention aims at providing a new and improved method and apparatus of the previously mentioned type which permit the formation of a very compact intermediate storage coil or package by the properly positioned or oriented delivery of printed products to the winding mandril, respectively to the intermediate storage coil or package forming thereupon, yet permit obtaining an imbricated product formation after unwinding in which the printed products assume the desired, i.e. original, position or orientation through simple structural means.

Yet a further significant object of the present invention aims at providing a new and improved apparatus of the character described which is relatively simple in concept, extremely economical to realize, highly reliable in use, not readily subject to breakdown or malfunction and requires a minimum of maintenance and servicing.

Now in order to implement these and still further objects of the invention, which will become more readily apparent as the description proceeds, the method of the present invention is manifested by the features that it comprises the intermediate step of altering the position or orientation of the printed products within the imbricated product formation such that the predetermined edges of the printed products, which were trailing in the arriving imbricated product formation, are caused to lead before winding up the printed products to form an intermediate storage coil or wound package.

The apparatus of the present invention is manifested by the features that it comprises a position-altering device arranged rearwardly or behind or upstream of the conveyor device and through which the arriving printed products pass, and that the position-altering device alters the position of the printed products within the imbricated product formation to form an altered imbricated product formation such that the prior trailing edges of the printed products become leading edges in the altered imbricated product formation. The terms "rearwardly", "rearmost", "behind" and "upstream" are to be understood as designating any region of the inventive apparatus preceding a given point in the direction of motion of the imbricated product formation, while the terms "forwardly", "foremost", "ahead of" and "downstream" designate regions following a given point in the direction of motion.

The fact that the printed products are mutually placed in a different but predetermined position or orientation within the altered imbricated product formation before winding up assures that the printed products are wound up with their leading edges adjacent to or in contact with the winding mandril, respectively the intermediate storage coil or package forming thereupon, as is necessary for obtaining a compact wound product coil or wound product package. Stated in another way, the leading edges of the printed products are closer to the axis of rotation of the winding mandril than the trailing edges. It also assures that when the printed products are unwound from the intermediate storage coil or package, the printed products in the imbricated product formation issuing from the intermediate storage coil or package nevertheless have the same position or orientation as in the originally arriving imbricated product formation.

In the case where each printed product in the arriving imbricated product formation overlies or overlaps the preceding printed product, the position-alteration of the printed products is preferably performed such that the printed products are separated or singled and are then redeposited upon one another such that the edges that were the leading edges in the arriving imbricated product formation or stream become the trailing edges and the printed products are inverted or turned over in order to place those sides thereof which were uppermost in the arriving imbricated product formation upon the underside.

The arriving imbricated product formation is preferably divided into at least two imbricated product subformations before the position or orientation of the printed products in each such imbricated product subformation is altered in the manner described above. After this position-alteration, the imbricated product subformations are reunited into a single imbricated product formation or flow. This division of the imbricated product formation permits the position-alteration of the printed products to be performed at a speed which is lower than the delivery speed of the arriving imbricated product formation or stream.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing of the drawings only enough of the structure of the apparatus has been illustrated therein as is needed to enable one skilled in the art to readily understand the underlying principles and concepts of this invention. The illustrated exemplary embodiment of the apparatus for the intermediate storage of printed products or the like arriving in an imbricated product formation or stream will be seen to comprise a conveyor or transporter 2 which transports the printed products 1 to be stored from a not particularly shown source, for instance from the delivery belt of a rotary printing press or rotogravure machine. The conveyor or transporter 2 is only schematically represented and is of a known type of construction described, for instance, in the U.S. Pat. No. 3,955,667.

Figure 1:
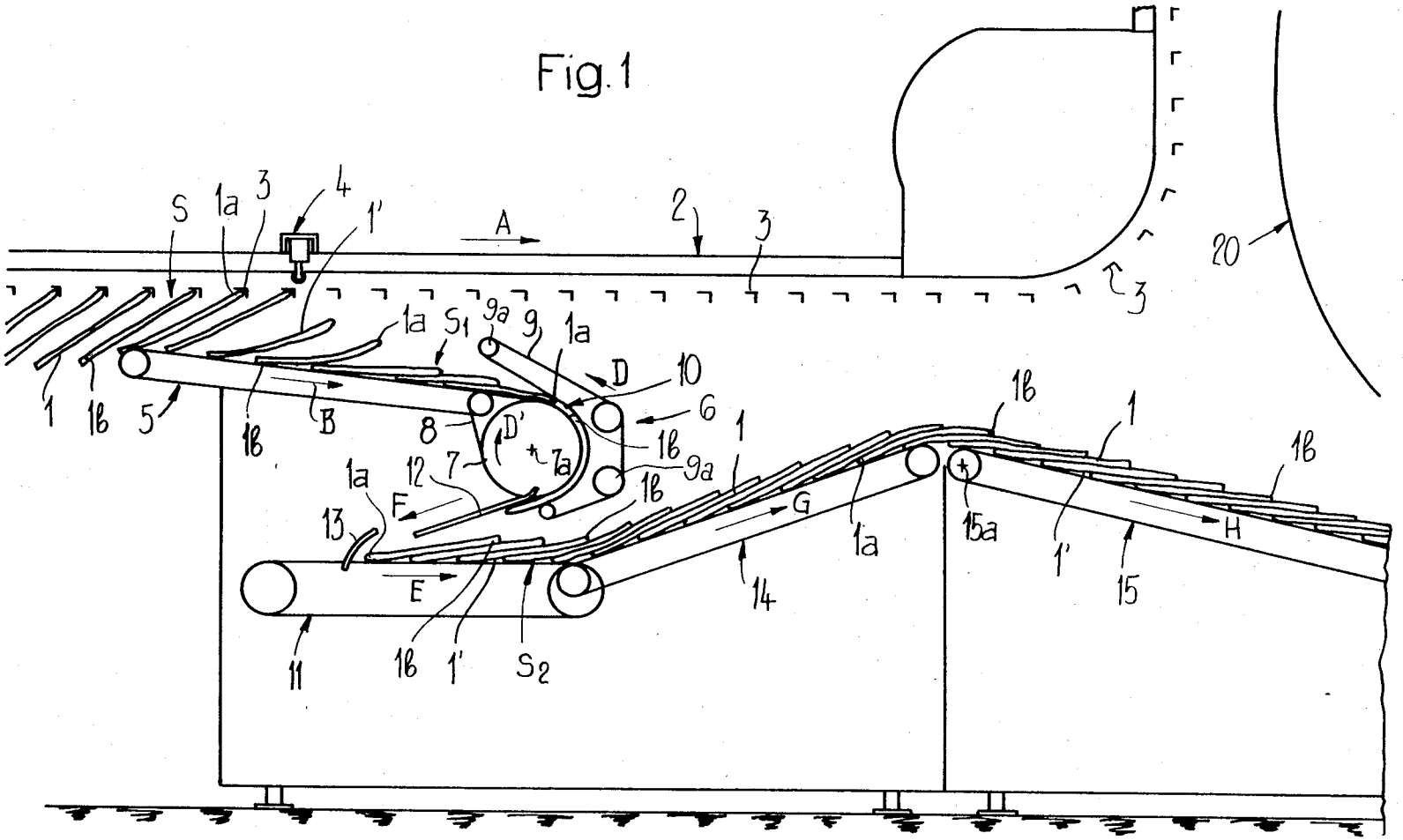
FIGS. 1 and 2 schematically show a first exemplary embodiment of an apparatus according to the invention for the intermediate storage of printed products.

The conveyor or transporter 2, whose direction of transport is designated with the reference character A, comprises controllable grippers or clamps 3 arranged sequentially in the transport direction A which grip or seize the printed products 1 at their leading edges 1*a*, which are as a rule the folded edges. An opening device 4, also of known construction, is provided for opening the grippers or clamps 3. As shown in FIG. 1, a belt conveyor 5 is arranged beneath this opening device 4 and is driven in the direction of the arrow B by any suitable means. This belt conveyor 5 has substantially the same transport direction as the conveyor or transporter 2.

A turning or deflection apparatus 6, also forming a product inverting device and, in one embodiment of the invention, a separator or singling device as well follows immediately downstream of the belt conveyor 5 and comprises a deflection or turn guide roll 7 driven to rotate in the direction of the arrow D' and whose axis of rotation 7*a* extends transverse and preferably substantially perpendicular to the transport direction B of the belt conveyor 5. At least one endless drive belt 8 runs over this turn guide roll 7. One leg or run of an endless counterbelt 9 is driven over guide rolls 9*a* in the direction of the arrow D and along a portion of the circumference of the turn guide roll 7 to form a predetermined gap between the turn guide roll 7 and the counterbelt 9. Such one leg or run of this counterbelt 9 forms conjointly with the turn guide roll 7 a transport or conveying gap 10.

A further belt conveyor 11 is arranged beneath the deflection or turning apparatus 6 whose transport direction is designated with the reference character E. A guide member 12 is arranged above this belt conveyor 11 immediately downstream of the outlet of the conveying gap 10. Furthermore, a fixed stop or abutment 13 is provided above the belt conveyor 11 and at a spaced distance from the outlet of the conveying gap 10. A further belt conveyor 14 is arranged subsequent to the belt conveyor 11 and has a transport direction G with the same orientation.

Figure 2:
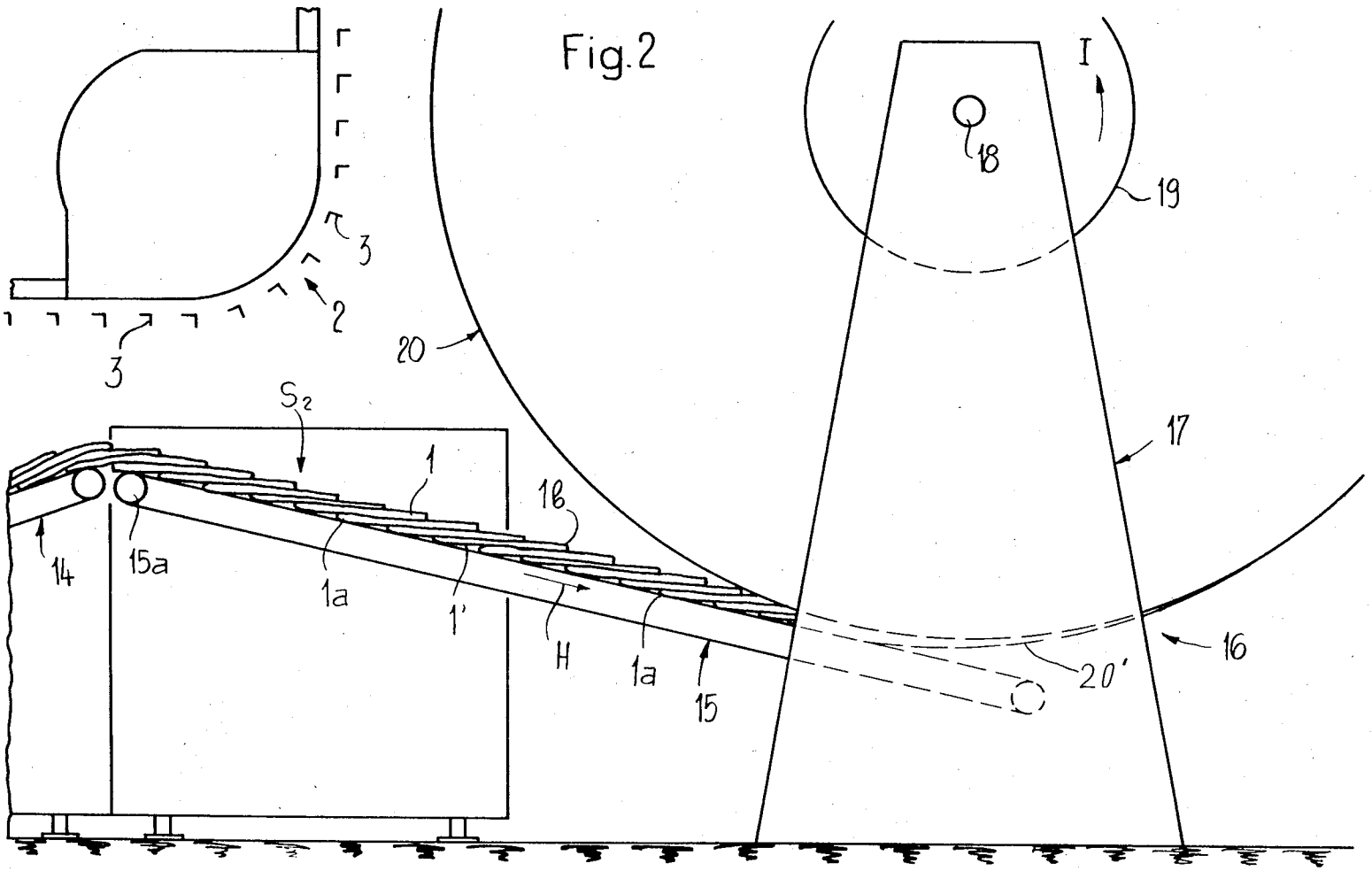

A winding apparatus is arranged immediately subsequent to the belt conveyor 14 and is shown in partial view in FIG. 1 and in full view in FIG. 2. This winding apparatus comprises a conveyor device 15 immediately downstream of the belt conveyor 14 and having a transport direction designated with the reference character H. This conveyor device 15 is constructed as a rocker or balance arm which is pivotable about a pivot axis or shaft 15*a* and comprises a conveyor belt or several conveyor belts arranged in parallel.

A not particularly shown actuating mechanism such as that described in the previously mentioned U.S. Pat. No. 4,438,618, engages this rocker or balance arm conveyor device 15 to press it against a wind-up and storage unit 16 arranged immediately subsequent to the conveyor device 15 and whose construction is described in more detail in the commonly assigned U.S. patent application No. 06/432,557, filed Oct. 12, 1981. This winding and storage unit 16 comprises a mobile frame or support 17 in the form of a bearing pedestal in which the shaft 18 of a cylindrical winding mandril or core 19 is journaled. This winding mandril or core 19 is connected with not particularly shown suitable drive means which drives the winding mandril or core 19 in the direction of the arrow I, as is described in more detail in the previously mentioned U.S. Pat. No. 4,438,618 to which reference may be readily had.

As is shown in the previously mentioned U.S. patent application No. 06/432,557, to which reference may be likewise had and the disclosure of which is incorporated herein by reference, a suitable supply drum or roll, not particularly shown in FIG. 2, is journaled in the frame or support 17 for a winding band or strap 20' which is fixedly connected with the winding mandril or core 19. This winding band or strap 20' can be placed under tension by means of any suitable tensioning device also not particularly shown, but for instance disclosed in the aforementioned U.S. Pat. No. 4,438,618.

The manner of operation of the described apparatus is as follows:

As the grippers or clamps 3 of the conveyor or transporter 2 pass by the opening device 4, these grippers or clamps 3 are opened. The printed products 1 delivered in imbricated product formation S by the conveyor or transporter 2 are thus released and fall onto the belt conveyor 5 upon which they overlap one another in the manner of shingles and thereby form a new imbricated product formation $S_1$. Both imbricated product formations S and $S_1$ are similar in that each printed product 1 overlies or overlaps a preceding printed product. The leading edges 1*a* of the printed products 1 are therefore exposed while the trailing edges 1*b* are each overlapped or covered over by the subsequent printed product 1.

The belt conveyor 5 conveys the printed products 1 to the inlet of the conveying gap 10 of the deflection or turning apparatus 6. As the printed products 1 run into this conveying gap 10, they are gripped or seized at their leading edges 1*a* by the deflection or turn guide roll 7, respectively by the drive belt 8 and the counterbelt 9, and are transported through the conveying gap 10. Since the deflection or turn guide roll 7 and the counterbelt 9 are driven at a speed which is higher than the transport speed of the belt conveyor 5, each gripped printed product 1 is separated or singled, that is withdrawn from underneath the subsequent printed product, as will be seen in FIG. 1. The individual printed products 1 exiting from the conveying gap 10 are transported underneath the guide member 12 against the stop 13 with a direction of motion F opposite to the transport direction B of the belt conveyor 5.

After the printed products 1 impinge with their leading edges 1*a* upon the stop 13, they are deposited upon the belt conveyor 11, respectively upon the printed products 1 previously deposited thereupon. A new imbricated product formation $S_2$ is formed upon this belt conveyor 11 whose transport direction E is opposite to the direction of motion F of the printed products 1 approaching the stop 3. In the new imbricated product formation $S_2$, each printed product 1 overlies or overlaps the preceding printed product just as in the original imbricated product formation S, respectively $S_1$. However, the leading edge 1*b* is now formed by that edge 1*b* which in the original imbricated product formation or flow S formed the trailing edge. As the printed products 1 run through the deflection or turning apparatus 6, they are also turned over, that is their sides 1' which were lying upward in the original imbricated product formation S, respectively $S_1$, are caused to lie on the underside of the imbricated product formation or stream $S_2$.

The imbricated product formation $S_2$ is guided over the belt conveyor 14 and the conveyor device 15 to the driven winding mandril or core 19, respectively to the product coil 20 forming thereupon, and is wound up conjointly with the previously mentioned winding band or strap 20' located on the underside of the imbricated product formation $S_2$, as is explained in more detail in the previously mentioned U.S. Pat. No. 4,438,618.

Since the leading edges 1*b* of the printed products 1 in the imbricated product formation $S_2$ delivered in underfeed to the winding mandril or core 19, respectively to the intermediate storage coil or package 20, lie upon the upper side of this imbricated product formation $S_2$, i.e. the closer to the axis of rotation of the winding mandril than the trailing edges, the printed products come into contact with the intermediate storage coil or package 20 with these leading edges 1*b*, which fulfills the prerequisite for the ability of each inner layer of the product coil or package 20 to further rotate with respect to the next outer layer in the direction of rotation I. In this manner the coil or package 20 can be further rotated from the interior in the manner of a clock spring which produces a compact coil or package. The term "underfeed" as used herein is not to be understood as necessarily a feed from beneath, but as a feed in which the printed products enter into contact with the outer layer of the wound coil or product package with the leading edges, or stated in another way, a feed of the printed products such that the leading edges thereof are situated closer to the axis of rotation of the winding mandril than the trailing edges.

Since the originally upper side 1' and the originally leading edge 1*a* of each printed product 1 in this imbricated product formation $S_2$ to be wound up lie on the underside, an imbricated product formation can again be obtained in which the printed products have the same position or orientation as in the original imbricated product formation S when the imbricated product formation $S_2$ is unwound from the intermediate storage coil or package 20 by simply turning over this imbricated product formation $S_2$. Such a turning over of the imbricated product formation $S_2$ when it is unwound from the coil 20 can be performed with the aid of a suitable inverting or turning over device known per se and not particularly shown which substantially corresponds to the inverting or turning apparatus 6 but in which no separation or singling of the printed products 1 occurs.

Figure 3:
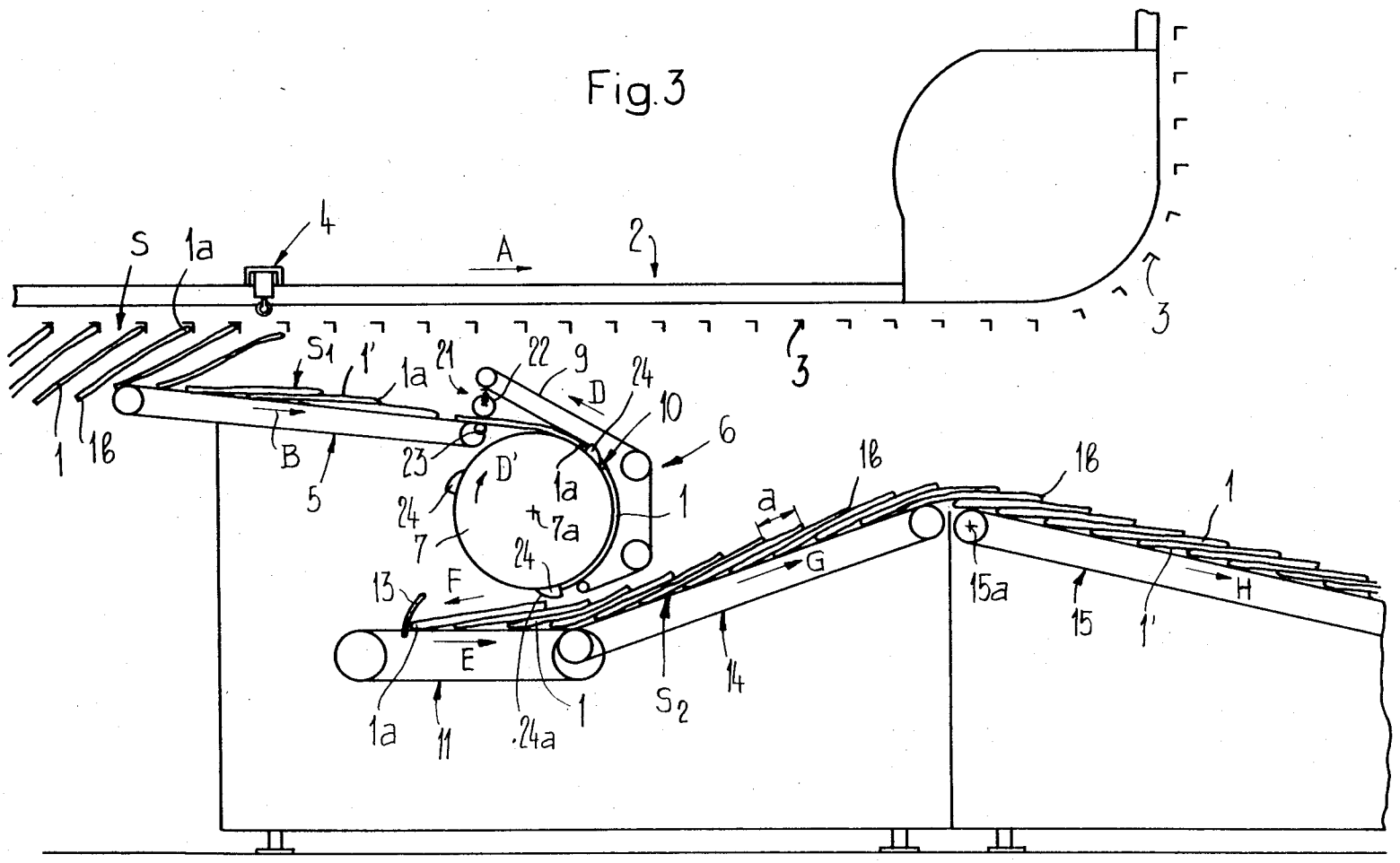
FIG. 3 schematically shows a further exemplary embodiment of a device for altering the position of the printed products within the imbricated product formation.

A deflection or turning apparatus 6 is shown in FIG. 3, which is representationally equivalent to FIG. 1, which differs from the deflection or turning apparatus 6 according to FIG. 1 in some of its components, as will be described in the following. The same reference characters have been generally used for mutually corresponding components of FIG. 1 and FIG. 3.

In the deflection or turning apparatus 6 according to FIG. 3, the separation or singling, i.e. the acceleration, of the printed products 1 is performed, not by the turn guide roll 7 and the counterbelt 9, but by an acceleration apparatus 21 which is arranged subsequent to or downstream of the belt conveyor 5 and behind or upstream of the inlet into the conveying gap 10. This acceleration device 21 comprises at least a pair of acceleration rolls 22 and 23 suitably driven in not particularly shown manner, between which the printed products 1 run. Since these rolls 22 and 23 rotate with a circumferential or tangential speed which is greater than the transport speed of the preceding belt conveyor 5, the printed products 1 gripped by the rolls 22 and 23 are accelerated and withdrawn from beneath the respective subsequent printed product.

The separated or singled printed products traveling at the higher speed are conveyed to the conveying gap 10 in which they are gripped by the deflection or turn guide roll 7 and the counterbelt 9. The turn guide roll 7 has stop or positioning elements 24 distributed about its periphery and protruding in upright fashion therefrom.

The printed products 1 accelerated by the acceleration device 21 impinge with their leading edges 1*a* upon these stop or positioning elements 24, as can be seen in FIG. 3. The stop or positioning elements 24 are arranged in mutual spaced relationship along the peripheral or circumferential direction of the turn guide roll 7. The distance between them is somewhat greater than the length of the printed products 1 between their leading and trailing edges 1*a*, respectively 1*b*.

The fact that the distance or spacing between the leading edges 1*a* of sequential printed products 1 is determined by the spacing of the stop or positioning elements 24 assures that the imbricated product formation $S_2$ formed upon the belt conveyor 11 has a constant imbrication distance (a). The stop or positioning elements 24 extending upright from the circumference of the turn guide roll 7 also assure that each printed product 1 leaving the conveying gap 10 does not collide with the preceding printed product which is in the process of depositing itself upon the belt conveyor 11 in that the stop or positioning elements 24 press this preceding printed product downward with their leading surfaces 24*a*.

The manner of operation of the deflection or turning apparatus 6 according to FIG. 3 otherwise corresponds to the manner of operation of the deflection or turning apparatus according to FIG. 1.

Figure 4:
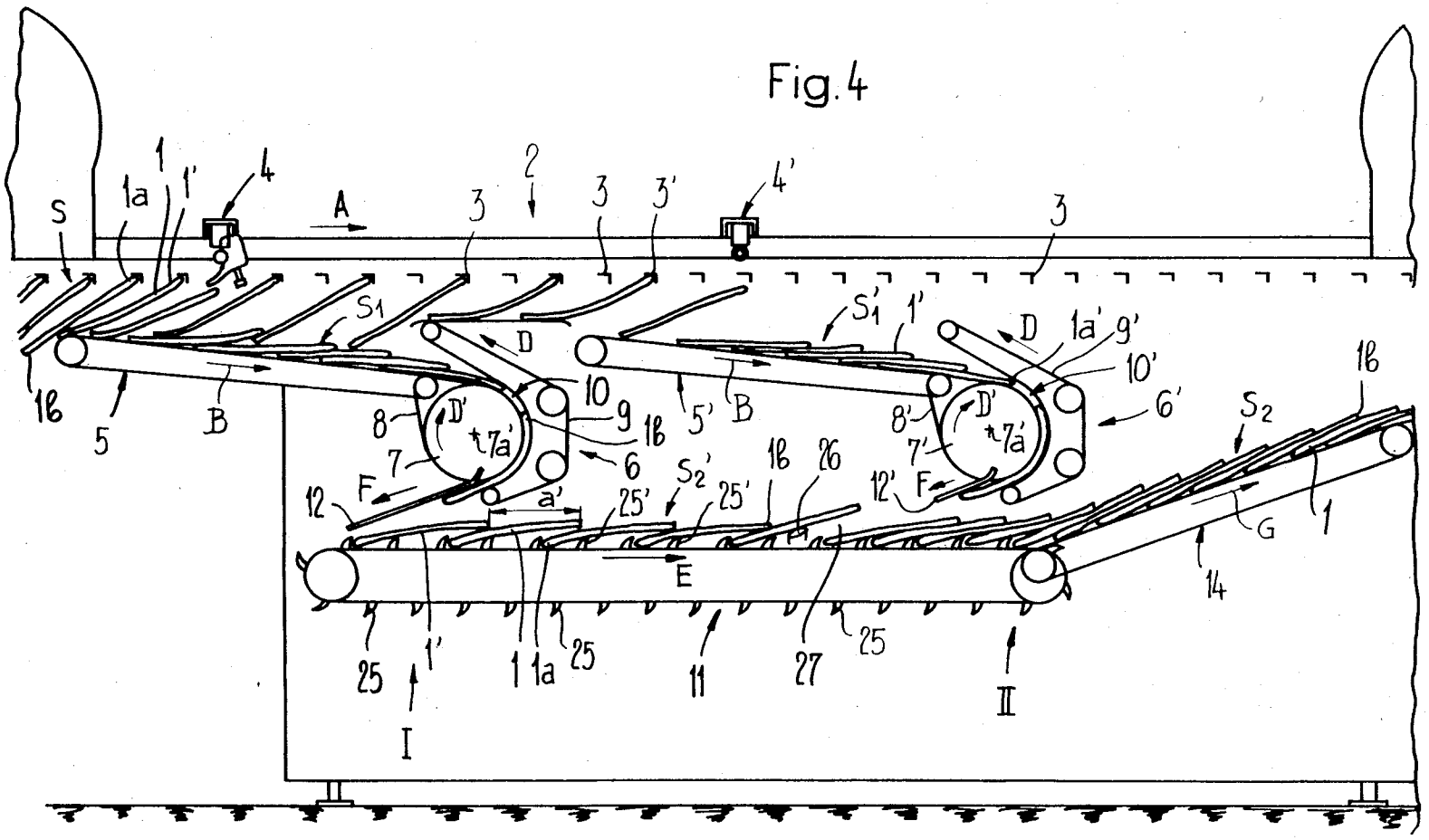
FIG. 4 schematically shows a further alternate embodiment of a device for altering the position of the printed products within the imbricated product formation.

In contrast to the embodiments according to FIGS. 1 through 3, in the embodiment according to FIG. 4 the described position-alteration of the printed products 1 takes place at not only one station but at two stations I and II. These two stations I and II, which are substantially identical in construction, are arranged sequentially in the transport direction A of the conveyor or transporter 2. Each of these stations I and II comprises a deflection or turning apparatus 6, respectively 6', which in its construction and operation corresponds to the deflection or turning apparatus 6 according to FIG. 1.

A belt conveyor 5 and 5' is arranged upstream of each deflection or turning apparatus 6 and 6', as in the embodiment according to FIG. 1. An opening device 4 and 4' for opening the grippers or clamps 3 is arranged above each belt conveyor 5 and 5', respectively. That opening device, here the opening device 4, which is rearmost in the transport direction A is controlled such that it opens only every other gripper or clamp 3. The grippers or clamps 3' not released or opened by this opening device 4 are subsequently opened by the foremost opening device 4'.

Both stations I and II are mutually connected by the belt conveyor 11 arranged beneath the deflection or turning apparatuses 6 and 6'. This belt conveyor 11 comprises stop members 25 arranged in prescribed mutual spaced relationship and circulating therewith. These stop members 25 assume, among other things, the function of the stop 13 provided in the embodiment according to FIGS. 1 and 3.

The circulation or peripheral speed of the belt conveyor 11 and the distance between adjacent stop members 25 are so related to the transport speed of the printed products 1 leaving the conveying gap 10 of the deflection or turning apparatus 6 and 6' that, at the station I, the printed products 1 exiting from the conveying gap 10 are only transported to impinge against every second stop member 25, by which they are then entrained. The printed products 1 leaving the conveying gap 10' of the foremost deflection or turning apparatus 6' are then transported to impinge upon the still unoccupied [intermediate] stop members 25' by which they are then entrained.

In order to make this possible, a lifting or raising member 26 only schematically represented in the drawings is present ahead of the foremost deflection or turning apparatus 6' as seen in the direction of motion E of the belt conveyor 11. The lifting or raising member 26 lifts or raises the printed products 1 already deposited upon the belt conveyor 11 in order to form an opening or gap 27 between sequential printed products 1 into which the printed products 1 exiting from the conveying gap 10' can be inserted.

The manner of operation of the apparatus according to FIG. 4 is as follows:

Since, as previously mentioned, only every second gripper or clamp 3 is opened by the rearmost opening device 4, only half of the printed products 1 of the arriving imbricated product formation S are deposited upon the rearward belt conveyor 5 while the other half of the printed products 1 is deposited upon the forward belt conveyor 5'. The arriving imbricated product formation or stream S is therefore provisionally divided into two imbricated product subformations $S_1$ and $S_1$. Each of these subformations or partial product streams $S_1$ and $S_1'$ is conducted to the corresponding deflection or turning apparatus 6 or 6' in which a separation or singling and a turning over of the printed products 1 takes place in the manner described in relation to FIG. 1.

The printed products 1 leaving the deflection or turning apparatus 6 are deposited upon the belt conveyor 11 in the manner described to form a new imbricated product formation $S_2'$ in which each printed product 1 is deposited with a side 1' which was upward in the arriving imbricated product formation S now downward and in which the trailing edge 1*a* is formed by the edge 1*a* which was a leading edge in the original imbricated product formation or stream S. This imbricated product formation $S_2'$ has an imbrication spacing (a') which is greater than the imbrication spacing in the arriving imbricated product formation or stream S, that is, about twice as large.

The printed products 1 leaving the forward deflection or turning apparatus 6' are, as previously mentioned, each inserted between two printed products 1 having passed through the station I. In this manner an imbricated product formation $S_2$ is formed at the end region of the belt conveyor 11 which corresponds to the imbricated product formation $S_2$ according to FIGS. 1 through 3. Therefore both imbricated product subformations $S_1$ and $S_1'$ are reunited to a single imbricated product formation or stream $S_2$ by the belt conveyor 11 after the position-alteration of the printed products 1. This imbricated product formation or stream $S_2$ is guided over the belt conveyor 14 and the conveyor device 15 to the winding and storage unit 16 and wound up in the manner described in relation to FIGS. 1 and 2.

Since in the embodiment according to FIG. 4 each station I and II has only to process half as many printed products 1 in comparison to the deflection or turning apparatus 6 according to FIGS. 1 and 3 for an equivalent arriving imbricated product formation S, the position-alteration of the printed products 1 in the deflection or turning apparatuses 6 and 6' can be carried out at a speed which is lower than the processing speed in the embodiments according to FIGS. 1 and 3, that is, which is only about half as great. This reduced throughput or processing speed of the printed products 1 by the deflection or turning apparatuses 6 and 6' therefore permits a flawless position-alteration of the printed products 1 without damage to the printed products even when the latter are supplied by the conveyor or transporter 2 at extremely high speed.

Of course, various components of the devices described can also be constructed other than as shown here. Only a few of the variously possible alternatives will be described in the following.

In the embodiment according to FIG. 4, deflection or turning apparatuses of a preceding acceleration device 21 can also be employed instead of the deflection or turning apparatuses 6 and 6', which correspond to the deflection or turning apparatus 6 according to FIG. 1, as is shown in FIG. 3.

In all embodiments, the printed products 1 are not conveyed to impinge against a stop 13, respectively 26, and deposited upon the conveyor belt 11 whose direction of transport E is opposite to the direction of motion F of the printed products 1 leaving the deflection or turning apparatus 6 until after having run through the deflection or turning apparatus 6, i.e. not until after having been turned over. It is, however, also conceivable to separate the printed products 1 by acceleration, to convey them to impinge upon a stop and then to deposit them upon a conveyor belt located beneath the stop and whose transport direction is opposite to the direction of motion of the printed products 1 approaching the stop before turning them over, i.e. before delivering them to the deflection or turning apparatus 6. In such case, the printed products 1 must no longer run through the deflection or turning apparatus 6 individually as shown in FIG. 1 but can do this in imbricated product formation. This alternative embodiment has, however, the disadvantage that, in comparison to the embodiments shown, a somewhat greater structural expense is required.

While there are shown and described present preferred embodiments of the invention, it is to be distinctly understood that the invention is not limited thereto, but may be otherwise variously embodied and practiced within the scope of the following claims.

Accordingly, what I claim is:

1. A method for the intermediate storage of printed products arriving in an imbricated product formation, comprising the steps of:

delivering said printed products in an imbricated product formation with predetermined edges of the printed products trailing;

altering the position of the printed products within said imbricated product formation such that said predetermined edges now lead and upper sides of the printed products become lower sides; and winding up the printed products in imbricated product formation upon a winding mandril and conjointly with a winding band maintained under tension to form a wound product package with the predetermined, now leading, edges in contact with a next inner layer of the wound product package being formed.

2. The method as defined in claim 1, further including the steps of:

using as the winding mandril a driven winding mandril having an axis of rotation; and winding up the printed products upon the driven winding mandril such that the leading edges of the printed products are structured closer to the axis of rotation of the winding mandril than the trailing edges.

3. The method as defined in claim 1, wherein said step of altering said position of said printed products within said imbricated product formation further includes the steps of:

extracting the printed products from the imbricated product formation;

subsequently depositing the printed products upon one another such that a leading edge of each printed product overlaps a preceding printed product; and said leading edge of each printed product being formed by an edge thereof which was the trailing edge in the imbricated product formation previous to said step of altering the position of the printed products.

4. The method as defined in claim 1, further including the steps of:

dividing said delivered imbricated product formation into at least two partial imbricated product streams each comprising an imbricated product subformation;

altering said position of said printed products within each said imbricated product subformation such that edges of the printed products which trailed in said delivered imbricated product formation now lead; and subsequently reuniting said at least two partial imbricated product streams into a single imbricated product formation to be wound up.

5. An apparatus for the intermediate storage of printed products arriving in an imbricated product formation, comprising:

a rotatable and driveable winding mandril for winding up said printed products in imbricated product formation;

a conveyor device for transporting said imbricated product formation to be wound up to said windng mandril, respectively to a wound product package being formed thereupon;

a winding band operatively connected to the winding mandril and capable of being placed under tension;

said winding band being entrained between coil layers of the wound product package being formed as the imbricated product formation is wound up;

a position-altering device arranged rearwardly of said conveyor device and through which the arriving printed products pass;

predetermined edges of the printed products trailing within the imbricated product formation located rearwardly of the position-altering device;

said position-altering device altering the position of the printed products within the imbricated product formation to form an altered imbricated product formation such that the predetermined trailing edges of the printed products become leading edges and formerly upper sides become lower sides in said altered imbricated product formation;

said position-altering device comprising means for extracting said printed products from said imbricated product formation and for subsequently redepositing the printed products upon one another such that each printed product overlaps a preceding printed product and such that said predetermined trailing edges become said leading edges in said altered imbricated product formation; and the altered imbricated product formation being wound up such that said leading edges of the printed products are in contact with the winding mandril, respectively with the wound product package forming upon the winding mandril.

6. The apparatus as defined in claim 5, wherein: said conveyor device transports said imbricated product formation to said winding mandril from below.

7. The apparatus as defined in claim 5, further including:

means including said conveyor device for defining a transport path for said printed products;

at least one separator device for accelerating each of the printed products to a higher speed in relation to a subsequent printed product;

stop means arranged in said transport path of the separated printed products;

the printed products having a direction of motion causing them to impinge against said stop means with their leading edges;

said means defining said transport path including a further conveyor device arranged beneath the stop means; and said further conveyor device having a conveying direction which is opposite to said direction of motion of the printed products arriving at the stop means.

8. The apparatus as defined in claim 7, wherein:

said separator device is arranged adjacent to and rearwardly of said position-altering device.

9. The apparatus as defined in claim 7, wherein:

said position-altering device is structured to define said separator device.

10. The apparatus as defined in claim 7, wherein:

said position-altering device comprises at least one turning device for turning over said imbricated product formation such that the upper sides of said printed products become lower sides;

said imbricated product formation has a longitudinal direction of extent;

said at least one turning device defining an axis extending substantially transverse to said longitudinal direction of extent of the imbricated product formation;

said at least one turning device turning the imbricated product formation about said axis;

said at least one turning device for turning said imbricated product formation comprises:

a turn guide roll having an axis about which it is rotatable and driveable and defining said transversely extending axis;

at least one endless driven counterbelt extending along a portion of the circumference of said turn guide roll;

said counterbelt forming conjointly with the turn guide roll a conveying gap to be traveled through by said printed products;

the printed products entering said conveying gap having a first direction of travel;

the printed products leaving said conveying gap having a second direction of travel opposite to said first direction of travel of the printed products entering the conveying gap;

said printed products approaching said turn guide roll with a prescribed speed of motion;

the turn guide roll being driven at a tangential speed greater than said speed of motion of the printed products approaching the turn guide roll; and said stop means being located after the at least one turning device for turning said imbricated product formation.

11. The apparatus as defined in claim 7, wherein:

said position-altering device comprises at least one turning device for turning over said imbricated product formation such that the upper sides of said printed products become lower sides;

said imbricated product formation has a longitudinal direction of extent;

said at least one turning device defining an axis extending substantially transverse to said longitudinal direction of extent of the imbricated product formation;

said at least one turning device turning the imbricated product formation about said axis;

said at least one turning device for turning said imbricated product formation comprising:

a turn guide roll having an axis about which it is rotatable and driveable and defining said transversely extending axis;

at least one endless driven counterbelt extending along a portion of the circumference of said turn guide roll;

said counterbelt forming conjointly with the turn guide roll a conveying gap to be traveled through by said printed products;

the printed products entering said conveying gap having a first direction of travel;

the printed products leaving said conveying gap having a second direction of travel opposite to said first direction of travel of the printed products entering the conveying gap;

said printed products approaching said counter belt with a prescribed speed of motion;

the counterbelt being driven at a tangential speed greater than said speed of motion of the printed products approaching the counterbelt; and said stop means being located after the at least one turning device for turning said imbricated product formation.

12. The apparatus as defined in claim 7, wherein:

said position-altering device comprises at least one turning device for turning over said imbricated product formation such that the upper sides of said printed products become lower sides;

said imbricated product formation has a longitudinal direction of extent;

said at least one turning device defining an axis extending substantially transverse to said longitudinal direction of extent of the imbricated product formation;

said at least one turning device turning the imbricated product formation about said axis;

said at least one turning device for turning said imbricated product formation comprising:

a turn guide roll having an axis about which it is rotatable and driveable and defining said transversely extending axis;

at least one endless driven counterbelt extending along a portion of the circumference of said turn guide roll;

said counterbelt forming conjointly with the turn guide roll a conveying gap to be traveled through by said printed products;

the printed products entering said conveying gap having a first direction of travel;

the printed products leaving said conveying gap having a second direction of travel opposite to said first direction of travel of the printed products entering the conveying gap;

said printed products approaching said turn guide roll and said counterbelt with a prescribed speed of motion;

the turn guide roll and the counterbelt are being driven at a tangential speed greater than said speed of motion of the printed products approaching the turn guide roll and the counterbelt; and said stop means being located after the at least one turning device for returning said imbricated product formation.

13. The apparatus as defined in claim 7, wherein:

said position-altering device comprises at least one turning device for turning over said imbricated product formation such that the upper sides of said printed products become lower sides;

said imbricated product formation has a longitudinal direction of extent;

said at least one turning device defining an axis extending substantially transverse to said longitudinal direction of extent of the imbricated product formation;

said at least one turning device turning the imbricated product formation about said axis;

said at least one turning device for turning said imbricated product formation comprising:

a turn guide roll having an axis about which it is rotatable and driveable and defining said transversely extending axis;

at least one endless driven counterbelt extending along a portion of the circumference of said turn guide roll;

said counterbelt forming conjointly with the turn guide roll a conveying gap to be traveled through by said printed products;

the printed products entering said conveying gap having a first direction of travel;

the printed products leaving said conveying gap having a second direction of travel opposite to said first direction of travel of the printed products entering the conveying gap;

said separator device being located forwardly of said turning device for turning said imbricated product formation;

said turn guide roll being provided with positioning stop elements distributed around its periphery for engaging said leading edges of said printed products; and said stop means being located after the at least one turning device for turning the imbricated product formation.

14. The apparatus as defined in claim 13, wherein:

said separator device is formed by at least one pair of rolls for accommodating said printed products therebetween.

15. The apparatus as defined in claim 5, wherein:

said position-altering device comprises at least one device for turning over said imbricated product formation such that the upper sides of said printed products become lower sides.

16. The apparatus as defined in claim 15, wherein:

said imbricated product formation has a longitudinal direction of extent;

said at least one turning device defining an axis extending substantially transverse to said longitudinal direction of extent of the imbricated product formation; and said at least one turning device turning the imbricated product formation about said axis.

17. The apparatus as defined in claim 16, wherein:

said axis extends substantially perpendicular to said longitudinal direction of extent of said imbricated product formation.

18. The apparatus as defined in claim 16, wherein said at least one turning device for turning said imbricated product formation comprises:

a turn guide roll having an axis about which it is rotatable and driveable and defining said transversely extending axis;

at least one endless driven counterbelt extending along a portion of the circumference of said turn guide roll;

said counterbelt forming conjointly with the turn guide roll a conveying gap to be traveled through by said printed products;

the printed products entering said conveying gap having a first direction of travel; and the printed products leaving said conveying gap having a second direction of travel opposite to said first direction of travel of the printed products entering the conveying gap.

19. The apparatus as defined in claim 16, wherein:

said position-altering device comprises at least two sequentially arranged position-altering stations;

each of said at least two position-altering stations being supplied with a portion of an arriving imbricated product formation;

each of said at least two position-altering stations altering the position of a portion of said printed products associated therewith such that said predetermined trailing edges of the printed products become leading edges in the altered imbricated product formation;

each of said at least two position-altering stations comprising:

one said turning device for turning said imbricated product formation;

means for extracting said printed products from said imbricated product formation thereof;

a collecting conveyor arranged beneath said turning devices for turning the imbricated product formation of the at least two stations and connecting the latter with one another; and said collecting conveyor having a conveying direction opposed to a predetermined direction of motion of the printed products leaving the turning devices for turning the imbricated product formation.

20. The apparatus as defined in claim 19, wherein:

said at least two stations deposit a first imbricated product subformation and thereafter a second imbricated product subformation upon said collecting conveyor; and means for forming an opening between each of said printed products of said first imbricated product subformation when deposited upon said collecting conveyor for the insertion of respective printed products of said second imbricated product subformation.

21. The apparatus as defined in claim 19, wherein:

said collecting conveyor is provided with stop members arranged in mutually spaced relationship; and said printed products leaving said turning devices for turning said imbricated product formation impinging with said predetermined leading edges thereof against said stop members.

22. The apparatus as defined in claim 5, wherein:

said position-altering device comprises at least two sequentially arranged position-altering stations;

each of said at least two position-altering stations being supplied with a portion of an arriving imbricated product formation; and each of the at least two position-altering stations altering the position of a portion of said printed products associated therewith such that said predetermined trailing edges of the printed products become leading edges in the altered imbricated product formation.

* * * * *